US006655937B2

(12) United States Patent
Hasert et al.

(10) Patent No.: US 6,655,937 B2
(45) Date of Patent: Dec. 2, 2003

(54) PLASTIC VANE FOR A VANE-CELL VACUUM PUMP

(75) Inventors: Wolfram Hasert, Weinstadt (DE); Leonardo Cadeddu, Crema (IT); Monica Pilone, Vizzolo (IT)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/130,362

(22) PCT Filed: Sep. 19, 2001

(86) PCT No.: PCT/DE01/03598

§ 371 (c)(1),
(2), (4) Date: Oct. 7, 2002

(87) PCT Pub. No.: WO02/25113

PCT Pub. Date: Mar. 28, 2002

(65) Prior Publication Data

US 2003/0053924 A1 Mar. 20, 2003

(30) Foreign Application Priority Data

Sep. 21, 2000 (DE) ..... 100 46 697

(51) Int. Cl.[7] ..... F04C 15/00
(52) U.S. Cl. ..... 418/152; 418/178

(58) Field of Search ..... 418/152, 178; 264/439

(56) References Cited

U.S. PATENT DOCUMENTS 4,518,333 A * 5/1985 Seki et al. ..... 418/152
6,364,646 B1 * 4/2002 Kirtley et al. ..... 418/152

FOREIGN PATENT DOCUMENTS

JP 56009693 A * 1/1981 ..... F04C/18/344
JP 56052594 A * 5/1981 ..... F04C/18/352
JP 04060192 A * 2/1992 ..... F04C/18/22

* cited by examiner

*Primary Examiner*—Thomas Denion
*Assistant Examiner*—Theresa Trieu
(74) *Attorney, Agent, or Firm*—Ronald E. Greigg

(57) ABSTRACT

A vane cell vacuum pump has a rotor, in which a plastic vane, which with at least terminal part engages the inner wall of the jacket of a pump housing, is guided longitudinally. The body of the vane comprises a duroplastic and is united with the terminal part, of thermoplastic by an injection-molding operation. With the material comprising the body, high mechanical strength is attained, while with the material of the terminal part, high wear resistance and a low coefficient of friction are attained.

9 Claims, 1 Drawing Sheet

PLASTIC VANE FOR A VANE-CELL VACUUM PUMP

CROSS-REFERENCE TO RELATED APPLICATIONS

This application is a 35 USC 371 application of PCT/DE 01/03598 filed on Sep. 19, 2001.

BACKGROUND OF THE INVENTION

1. Field of the Invention

The invention is based on a plastic vane for a vane cell vacuum pump in which the vane has a body portion and a terminal part of different materials.

2. Description of the Prior Art

From German Utility Model DE-GM 75 03 397, a cell compressor is known that is equipped with plastic laminations or vanes. While the part of the laminations associated with the rotor of the cell compressor comprises a low-grade material, the terminal part of the laminations, which is associated with a jacket wall of the compressor housing, should conversely comprise a highly wear-resistant material. The parts of the laminations are produced separately from one another and joined together by methods such as adhesive bonding, riveting and welding. The two lamination parts can also be pressed together already during the production process. A multi-part lamination structure has the disadvantage that the individual tolerances of the lamination parts add up. This is especially harmful if laminations with parts of highly wear-resistant material disposed on both ends are produced in this way. Laminations or vanes produced in this way reach through the rotor and are meant to engage the housing sealingly on both ends, as is known for instance from U.S. Pat. No. 3,877,851.

SUMMARY OF THE INVENTION

The vane of the invention is advantageous in the sense that on the one hand, there is no need to mount separately produced individual parts, and on the other, the injection-molding tool determines the final shape of the vane replicably, with relatively close tolerances.

In one embodiment a structure of the vane is defined in which the body of the vane is first created by injection molding, transfer molding, or compression molding, and then, in the same injection-molding tool or a different one, the terminal part of the vane is completed.

A further feature of the invention is advantageous in the sense that on the one hand the dimensional accuracy of the vane is improved by a reduced influence of material shrinkage at the terminal part, and on the other, if the material of the terminal part is expensive, the costs of the vane can be kept low.

A joining of the parts can be accomplished in a simple way in the course of producing the vane, especially if with the materials used for the body and the terminal part of the vane, material engagement is not attainable.

With the heat treatment of the body of the vane an increase in the strength of the vane is attained by means of the maximum attainable, three-dimensional degree of cross-linking of the molecular structures and a constancy in the vane geometry by a reduction of tension in the microstructure of the material, as well as an avoidance of aftershrinkage.

BRIEF DESCRIPTION OF THE DRAWINGS

Other features and advantages of the invention will become apparent from the description contained herein below, with reference to the drawings, in which.

DESCRIPTION OF THE PREFERRED EMBODIMENT

Figure 1:
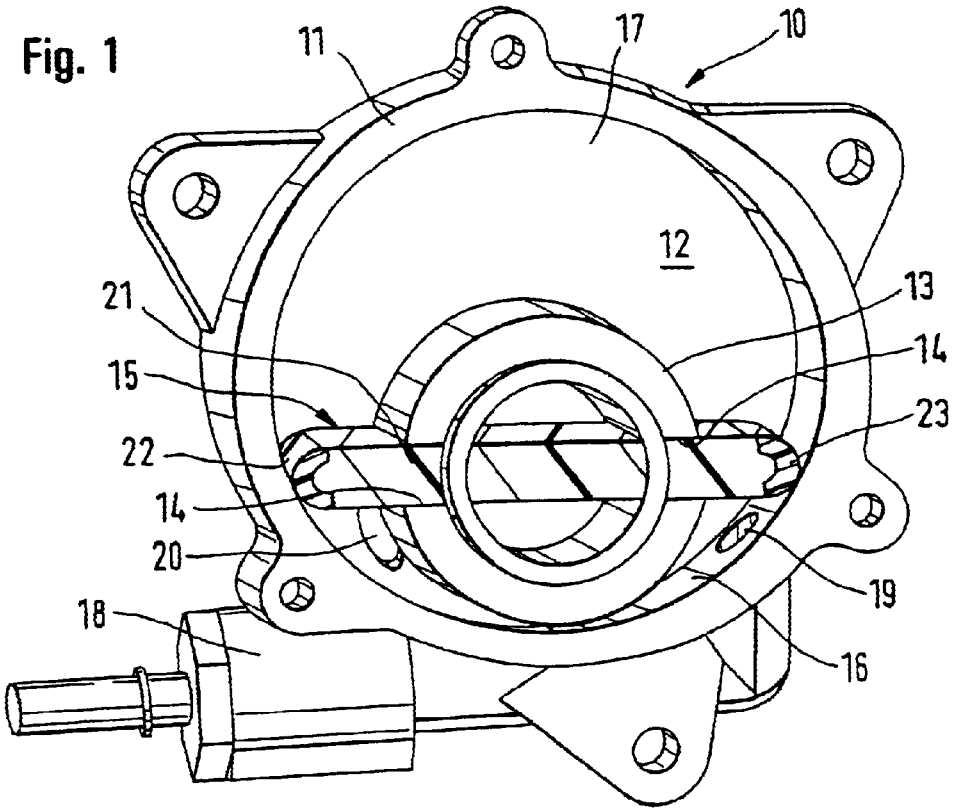
FIG. 1 shows a three-dimensional view of a vane cell vacuum pump with a single vane.

A vane cell vacuum pump 10 shown in FIG. 1 has a pump housing 11, shown without a cap, with an interior 12 in which a drivable rotor 13 is disposed eccentrically. The rotor 13 is provided with a transversely extending slot 14 for longitudinal guidance of a vane 15 made of plastic. The vane 15 both slidingly and sealingly engages an inner wall 16 on the jacket, an end wall 17, and the cap, not shown, of the pump housing 11. The pump housing 11 also has a suction neck 18 with an inlet opening 19, discharging on the jacket side into the interior 12, and an outlet opening 20 on the face end. The suction neck 18 communicates with a negative-pressure brake booster, not shown, of a vehicle brake system. The function of the vane cell vacuum pump 10 is known and therefore requires no further explanation here.

Figure 2:
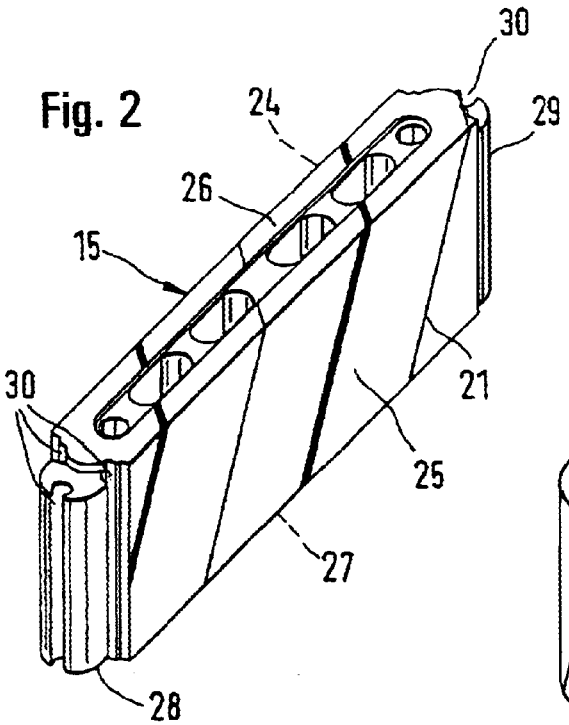
FIG. 2, as a three-dimensional view, shows the body of the vane.

The vane 15, embodied in the form of a lamination, is of plastic. Its body 21, shown in FIG. 2 of the drawing, is made from a duroplastic. It is produced by injection molding, transfer molding or compression molding from a glass-fiber-reinforced molding composition of phenol and Novolak, or a material of comparable properties. This material is distinguished by high mechanical and dynamic load-bearing capacity and oil resistance. Its material properties are largely constant in the temperature range from −40° C. to +150° C. The subsidence of the material is very slight over the service life of the vacuum pump 10. The material properties of the duroplastic named can be improved by tempering the body 21 for several hours.

Figure 3:
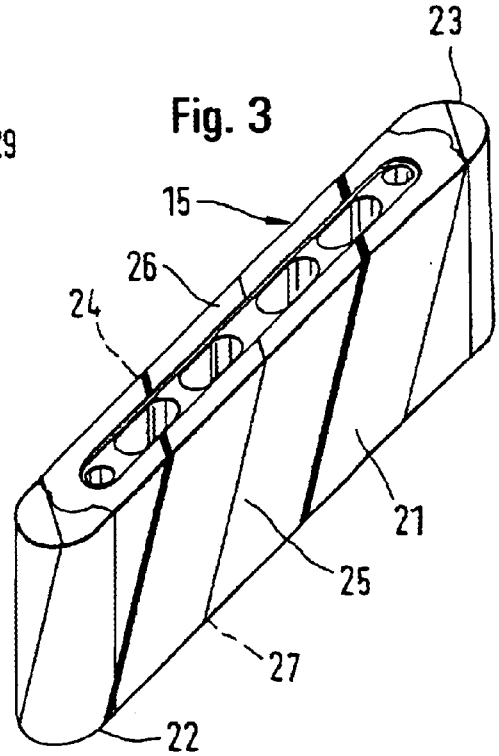
FIG. 3, also as a three-dimensional view, shows the vane completed with two terminal parts.

The vane 15 has formed-on terminal parts 22 and 23, which comprise a high-temperature-resistant thermoplastic such as polyaryletherketone (PEEK), or a material of comparable properties. This plastic, optionally modified with a specially assembled combination of fillers, has a wear resistance and a low coefficient of friction. The terminal parts 22 and 23 are united with the body 21 of the vane 15 by an injection-molding operation. To that end, the body 21, which is provided with graduatedly recessed end portions 28, 29 opposite its long sides 24, 25 and its narrow sides 26, 27 (see FIG. 2), is received in a tool mold and supplemented with the aforementioned thermoplastic to make the shape shown in FIG. 3. The two terminal parts 22 and 23 of the vane 15 in the process form semicylindrical shells of slight layer thickness, which as a lubricant coating envelop the end portions 28 and 29 of the body 21 and are flush with at least the short sides 26 and 27 of the body 21.

Since the plastics used for the body 21 and the terminal parts 22, 23 of the vane 15 cannot enter into a material or molecular engagement, or can enter only into an inadequate material engagement, provisions for attaining a positive engagement between the aforementioned parts and the body of the vane 15 are provided in the above-described embodiment of the vane 15. To that end, the end portions 28 and 29 of the body 21 have three longitudinally extending, rectilinear grooves 30 of semicircular to three-quarter-circular cross section, which in the injection-molding operation are filled up with the material of the terminal parts 22 and 23. In this way, detachment or separation of the terminal parts 22, 23 from the body 21 of the vane 15 is prevented.

In a modification of the above-described production process of the vane 15, the tempering of the body 21 can also be done, without damage to the terminal parts 22, 23, after the latter have been united with the body.

The production process can also be employed in vane cell vacuum pumps in which vanes having only a single terminal lubricant coating are used.

The foregoing relates to preferred exemplary embodiments of the invention, it being understood that other variants and embodiments thereof are possible within the spirit and scope of the invention, the latter being defined by the appended claims.

What is claimed is:

1. In a vane (15) of plastic for a vane cell vacuum pump (10), which vane is guided longitudinally in a rotor (13) and with at least one terminal part (22, 23) slidingly engages the inner wall (16) of the jacket of a pump housing (11), the body (21) of the vane (15) and its terminal part (22, 23) comprising different materials, of which the material comprising the terminal part (22, 23) has a high wear resistance, the improvement wherein the body (21) of the vane (15) comprises a duroplastic, and its terminal part (22, 23) comprises a thermoplastic, which plastics are joined together by an injection-molding operation to form a rigid vane structure.

2. The vane of claim 1, wherein after the molding of the body (21) of the vane (15), the terminal part (22, 23) is produced in an injection-molding operation.

3. The vane of claim 2, wherein the body (21) of the vane (15) and the terminal part (22, 23) are joined to one another by positive engagement.

4. The vane of claim 2, wherein the body (21) of the vane (15) is subjected to tempering, before or after the injection molding of the terminal part (22, 23).

5. The vane of claim 1, wherein the terminal part (22, 23) of the vane (15) is embodied as a layer of only slight thickness.

6. The vane of claim 2, wherein the terminal part (22, 23) of the vane (15) is embodied as a layer of only slight thickness.

7. The vane of claim 1, wherein the body (21) of the vane (15) and the terminal part (22, 23) are joined to one another by positive engagement.

8. The vane of claim 1, wherein the body (21) of the vane (15) is subjected to tempering, before or after the injection molding of the terminal part (22, 23).

9. A method of producing a plastic vane for a vane cell vacuum pump of the type having a pump body and a jacket in which the vane is guided longitudinally in a rotor, the method comprising initially forming an elongated vane body from a duroplastic material, the vane body having at least one end portion having at least one undercut groove formed therein, and subsequently forming a terminal end portion onto each said at least one end portion, each said terminal end portion being formed by injection molding from a thermoplastic having a high wear resistance and a relatively low coefficient of friction, whereby the thermoplastic material flows into each said at least one undercut groove to form a rigid unitary structure.

* * * * *